US005141390A

United States Patent [19]

Haentjens

[11] Patent Number: 5,141,390

[45] Date of Patent: Aug. 25, 1992

[54] VERTICAL AXIS CENTILEVERED PUMP PROVIDED WITH A STABILIZING BY-PASS FLOW

[76] Inventor: Walter D. Haentjens, R.D. #1, Box 121, Sugarloaf, Pa. 18249

[21] Appl. No.: 529,381

[22] Filed: May 29, 1990

[51] Int. Cl.[5] ..... F01D 17/00

[52] U.S. Cl. ..... 415/52.1; 415/58.4; 415/148; 415/206

[58] Field of Search ..... 417/423.3, 423.14, 424.1; 415/52.1, 56.1, 56.2, 56.5, 58.4, 146, 148, 182.1, 203, 206, 11

[56] References Cited

U.S. PATENT DOCUMENTS

| | | | |
|---|---|---|---|
| 1,382,665 | 6/1921 | Myers | 415/56.5 |
| 2,504,140 | 4/1950 | Mill | 415/203 |
| 2,625,110 | 1/1953 | Haentjens | 415/207 |
| 2,839,006 | 6/1958 | Mayo | 417/424.1 |
| 2,890,659 | 6/1959 | Haentjens | 415/52.1 |
| 3,048,117 | 8/1962 | Franzen et al. | 415/182.1 |
| 3,286,639 | 11/1966 | Hutton | 415/58.4 |
| 3,286,712 | 11/1966 | Roden | 417/424.1 |
| 3,936,221 | 2/1976 | Lobanoff | 417/424.1 |

FOREIGN PATENT DOCUMENTS

| | | | |
|---|---|---|---|
| 0611339 | 9/1926 | France | 415/11 |
| 0956572 | 2/1950 | France | 415/203 |
| 1173045 | 2/1959 | France | 415/148 |
| 0532705 | 9/1955 | Italy | 415/148 |
| 0516830 | 9/1976 | U.S.S.R. | 415/148 |

*Primary Examiner*—Edward K. Look
*Assistant Examiner*—Christopher M. Verdier
*Attorney, Agent, or Firm*—Hill, Van Santen, Steadman & Simpson

[57] ABSTRACT

A vertical-axis cantilevered-shaft centrifugal pump having an impeller within a pump casing, an intake end in fluid communication with a fluid supply, and a dischage end, in which is provided an integral by-pass. The pump is operated at a speed representing a relatively high level of pump efficiency to produce a relatively stable fluid flow from the fluid supply through the casing. The first portion of the fluid flow from the casing is directed through the discharge end of the pump, while a second portion of the fluid flow is diverted from the casing back to the fluid supply. The second diverted portion may be returned to the supply through a plurality of outlets located on volutes of the pump casing. The discharge from the pump can be controlled using a variable control valve adjacent the discharge end of the pump.

10 Claims, 3 Drawing Sheets

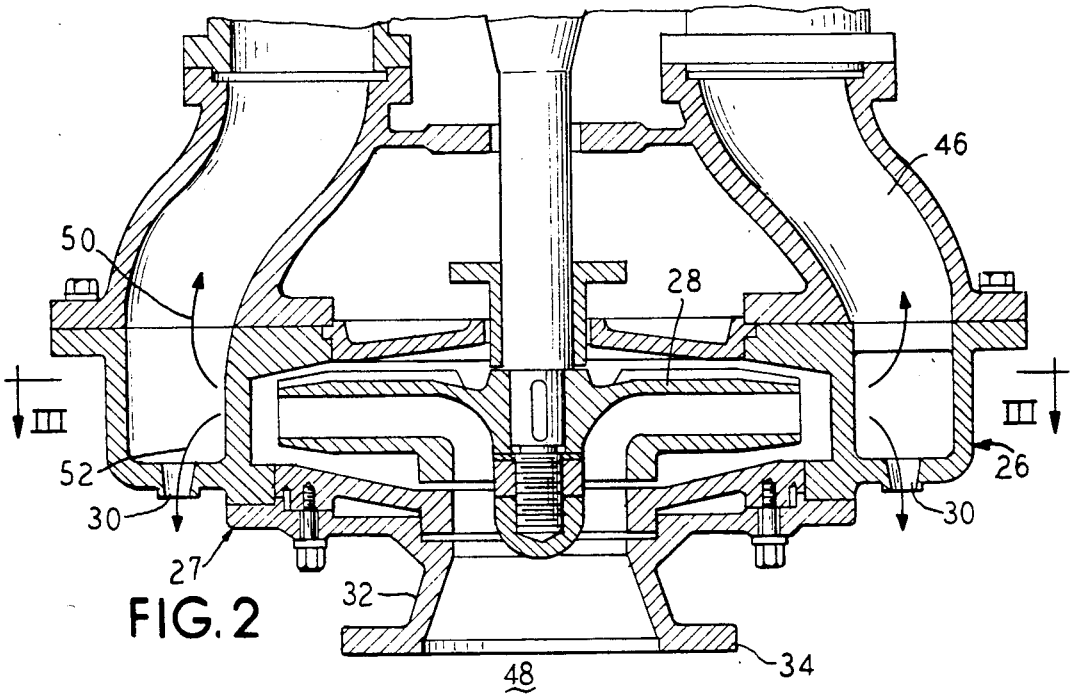
FIG. 2
FIG. 3
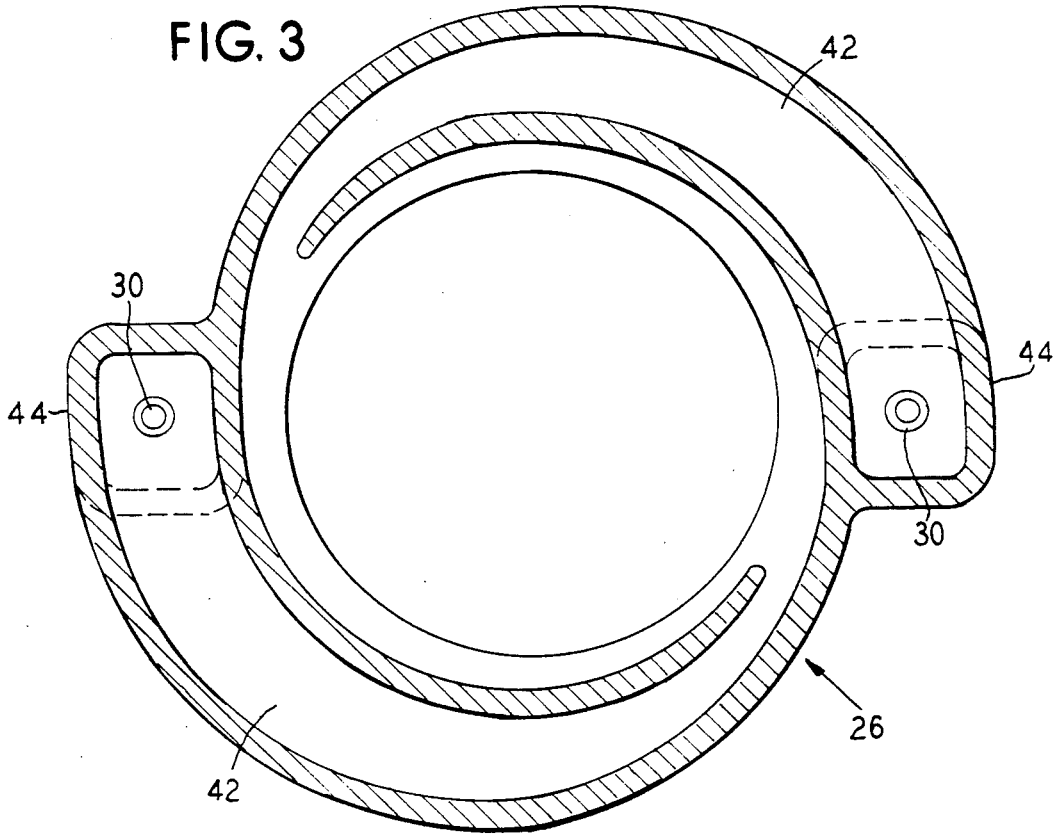

VERTICAL AXIS CENTILEVERED PUMP PROVIDED WITH A STABILIZING BY-PASS FLOW

TECHNICAL FIELD

The invention relates to vertical-axis cantilevered-shaft centrifugal pumps which maintain relatively constant discharge pressure while providing variable discharge flow rates.

BACKGROUND OF THE INVENTION

Various pump arrangements, for example those deployed in nuclear processing plants, require pumps that provide discharge at variable flow rates while maintaining essentially constant discharge pressure. These arrangements frequently employ vertical-axis cantilevered-shaft pumps. Such pumps are particularly well suited to nuclear processing plants, since they have no submerged bearings or stuffing boxes in the liquid or slurry to be pumped. Since these pumps are frequently located in radioactive areas and can not be readily serviced, the pumps must be able to operate at any point from shut-off to maximum specified flow rate, and utmost reliability is required.

Conventional centrifugal pumps can be operated at variable speeds to provide variable flow rates. However, conventional pumps are unsuitable for use in arrangements as described above, since their discharge pressures vary with the square of their speed ratios.

Simply operating a conventional centrifugal pump at constant speed and selectively throttling the discharge is also unsuitable, since the flow pattern through, and at the exit from, the impeller is significantly unstable, thus creating hydraulic forces that in turn cause severe vibration.

Furthermore, since low flow designs require smaller impeller openings, slurry in suspension tends to collect at the openings, and eventually obstructs or blocks pump discharge. This problem is exasperated if small pieces of solids are present in the slurry.

Finally, simply using a larger pump is also unsuitable, since operation of such pumps near the shut-off pump results in unstable hydraulic forces.

It is therefore apparent that the need exists for a vertical-axis cantilevered-shaft centrifugal pump that maintains a stable flow while providing variable discharge flow rates and maintaining a relatively constant discharge pressure.

SUMMARY OF THE INVENTION

It is, therefore, an object of the present invention to provide a vertical-axis cantilevered-shaft centrifugal pump that operates at high levels of efficiency and provides discharge having a variable flow rate, while maintaining a relatively constant discharge pressure and stable flow.

This and other objects are achieved by providing a vertical-axis cantilevered-shaft centrifugal pump having an integral by-pass. The by-pass permits the use of a high-capacity pump operated at near-maximum pump efficiency. While the flow rate through the impeller is relatively high, the actual discharge flow rate at the discharge end of the pump is maintained at a relatively low level.

In an exemplary embodiment, the invention includes a vertical-axis cantilevered-shaft centrifugal pump having an impeller within a pump casing, an intake end in fluid communication with a fluid supply, and a discharge end. The pump is operated at a speed representing a relatively high level of pump efficiency to produce a relatively stable fluid flow from the fluid supply through the casing. A first portion of fluid flow from the casing is directed through the discharge end of the pump, while a second portion of the fluid flow is diverted from the casing back to the fluid supply.

The second diverted portion may be returned to the supply through a plurality of outlets located on volutes of the pump casing. The openings may be generally frustoconical openings converging away from the pump casing.

The discharge from the pump can be controlled using a variable control valve adjacent the discharge end of the pump.

In the exemplary embodiment, the pump is operated at a level of efficiency between 85% and 100% of maximum efficiency. No more than approximately 25% of fluid flow from the casing is directed through the discharge end of the pump, and not less than 70% of fluid flow from the casing is diverted and returned to supply.

Other objects and advantages of the present invention will become apparent upon reference to the accompanying description when taken in conjunction with the following drawings.

BRIEF DESCRIPTION OF THE DRAWINGS

FIG. 2 is a sectional detail of a pump similar to that shown in FIG. 1.

FIG. 3 is a sectional view along lines III—III of FIG. 2.

DESCRIPTION OF THE PREFERRED EMBODIMENT

Figure 1:
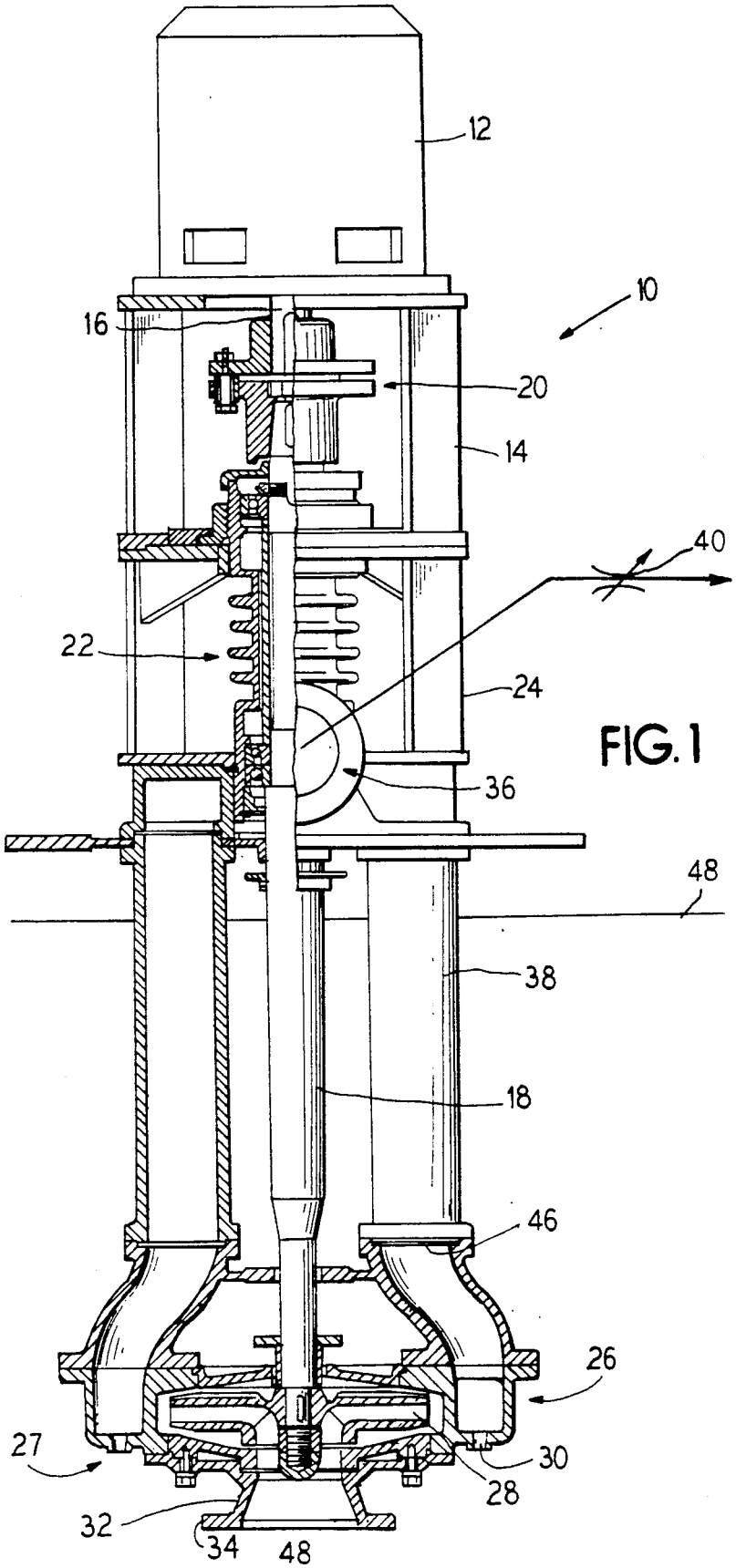
FIG. 1 is a part sectional view of a vertical axis cantilevered shaft pump embodying the present invention.

FIG. 1 shows a vertical axis cantilevered shaft pump 10 embodying the present invention. The pump 10 includes a motor 12 supported on a motor stand 14. A motor shaft 16 extends from the motor 12, and is connected to a pump shaft 18 via a shaft coupling 20. The pump shaft 18 passes through a bearing housing 22 that is borne by a bearing support 24, and extends downwardly from the bearing support 24 and into the impeller casing 26. An impeller 28 is housed within the impeller casing 26, and is attached to the pump shaft 18 for rotation therewith. As will be disclosed in detail hereinbelow, the casing 26 has an inlet end 27 that includes at least one throttled opening 30 and an inlet fitting 32 including a flange 34 which adapts the fitting 32 to be connected to a tailpipe (not shown). The casing 26 is in fluid communication with a discharge end 36 of the pump 10 via a series of connecting pipes 38. A variable control valve 40 is provided at the discharge end 36 of the pump 10 to regulate the amount of discharge flow.

As can be seen in detail in FIGS. 2 and 3, the casing 26 may include a pair of volutes 42 disposed diametrically opposite one another on the surface of the casing 26. The throttled openings 30, which may be provided in the form of generally frustoconical openings, are provided at the terminal ends 44 of the volutes 42, directly opposite the inlet ends 46 of the connecting pipes 38.

In operation, the motor 12 actuates the impeller to rotate to cause fluid from a fluid supply 48 to flow into the inlet fitting 32 at the intake end 27 of the pump 10 and through the pump casing 26. The pump speed and other characteristics are chosen such that the pump is operated at a high level of pump efficiency, preferably from 85% to 100% of maximum pump efficiency. The variable control valve 40 is used to selectively vary the discharge from the discharge end 36 of the pump within a predetermined range.

As can be seen in FIG. 2, fluid flow from the pump casing 26 is divided into a first portion, indicated by an arrow 50, that flows from the casing through the connecting pipes 38 and thereafter through the discharge end 36 of the pump 10, and a second portion 52 that flows from the pump casing 26 through the throttled openings 30, and is returned to liquid supply 48. Thus, only a fraction of the total flow through the casing 26 actually reaches the discharge end 36 of the pump 10. The pump 10 is therefore operated at a high degree of efficiency, and provides a variable flow rate while maintaining substantially constant discharge pressure.

Figure 5:
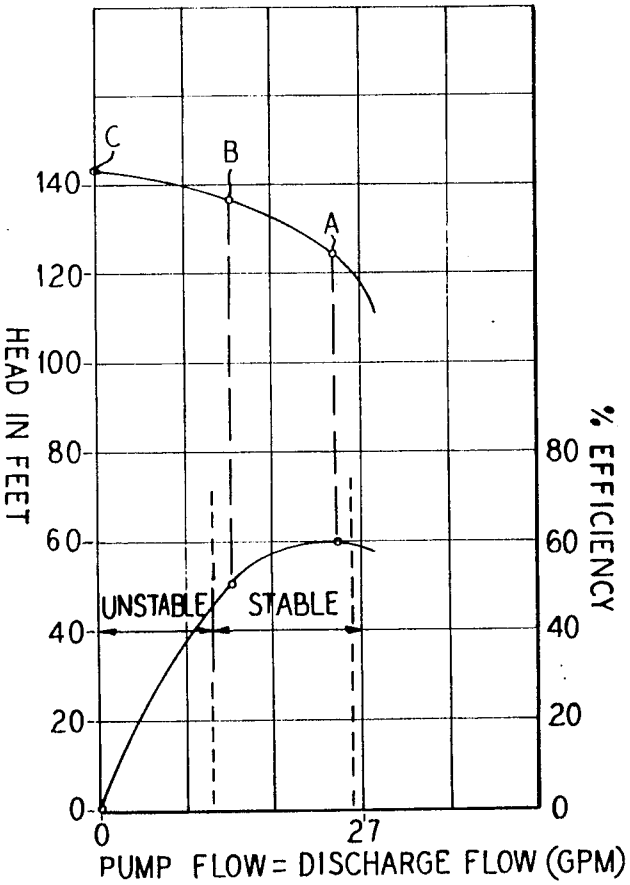
FIG. 5 (PRIOR ART)
FIG. 5 is a graphic representation of pump characteristics of a prior art pump.
Figure 4:
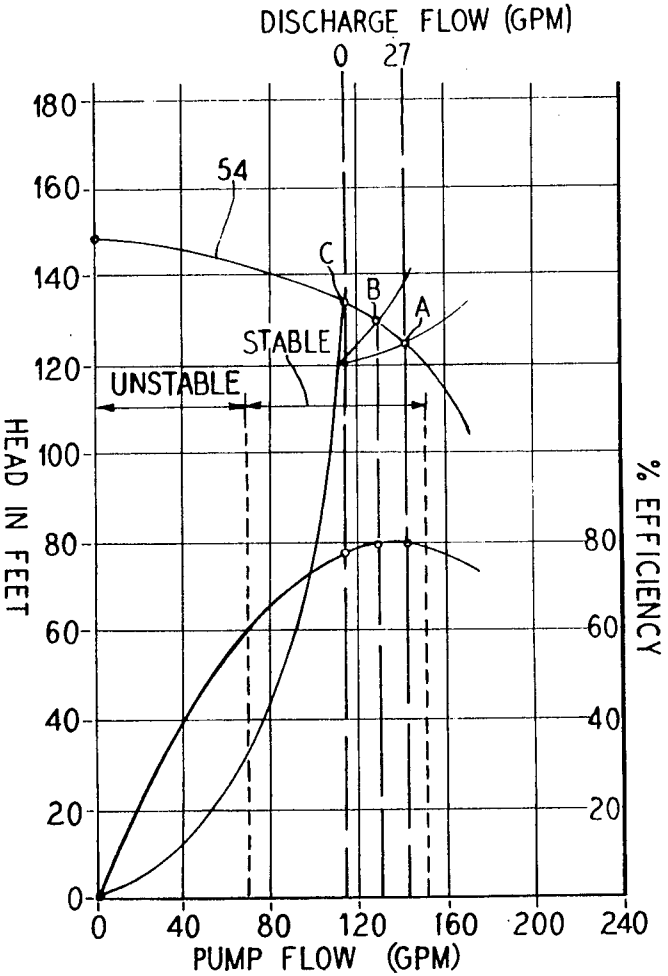
FIG. 4 is a graphic representation of pump characteristics of a pump embodying the present invention.

FIGS. 4 and 5 are graphic representations of pump characteristics of a pump embodying the present invention (FIG. 4) and a conventional, smaller pump operated over a similar discharge range (FIG. 5).

As shown in FIG. 4, a pump of this invention has a performance curve 54 which is the total flow through the impeller 28. Although the impeller/volute combination is such that the best efficiency condition is at 140 gallons per minute, the desired discharge from the pump at discharge 36 is in the range from 0 to 27 gallons per minute. The balance of the flow passes through nozzles 30 into the sump. Note that the total flow must meet a condition on the pump head-capacity characteristic curve. The distribution of the two flows is governed by the system head curve of the discharge flow. Note that at point "C" on the curve, FIG. 4, there is zero flow from the discharge flange but the pump is in a stable operating range. As the discharge valve is opened, there is flow from the discharge, the difference between points B and C, of approximately 16 gallons per minute. The head variation is only 4.5 feet of liquid. If the valve is opened fully, the maximum flow of 27 gallons per minute is achieved and the discharge head (pressure) only changes by 9.5 feet. These changes are shown as the discharge system head curves OA, OB and OC. Note that the full range of discharge flows remains approximately within 3% of the maximum pump efficiency and well within the region of stable operation. Also note that the total pump flow is divided as 27 gallons per minute and 142−27 or 115 gallons per minute for the recirculating flow. Thus the entire range of discharge flows can be made while the pump is operating in a stable region.

By contrast, the graph of FIG. 5 represents operation of a smaller, conventional pump wherein direct discharge is varied from 0 to 27 gallons per minute. A significant portion of pump operation occurs in the unstable range of fluid flow. Furthermore, the pump is operated at relatively low levels of efficiency, which has a detrimental effect on pump reliability.

It will become apparent to one of ordinary skill in the art that a pump embodying features of the present invention could be designed for any specified flow range, while still operating at close to the maximum pump efficiency with great reliability and stability of flow. Further, various casing arrangements for example a casing having an inlet above the impeller, could be employed.

It is recognized that the pump of the present invention may be considered inefficient in that more fluid is pumped than is actually needed. However, this consideration is outweighed by the degree of reliability and stability of flow provided by the present invention that is unattainable with previous designs.

Although the present invention has been described with reference to a specific embodiment, those of skill in the art will recognize that changes may be made thereto without departing from the scope and spirit of the invention as set forth in the appended claims.

I claim as my invention:

1. A vertical-axis cantilevered-shaft centrifugal pump having an impeller within a pump casing, an intake end in fluid communication with a fluid supply, and discharge end, said pump comprising the following:

means for operating said pump at a speed representing a relatively high level of pump efficiency to produce a relatively stable fluid flow from said fluid supply through said casing:

discharge means for directing a first portion of said fluid flow from said casing through said pump discharge end;

return means for diverting a remaining second portion of said fluid flow from said casing back to said fluid supply;

wherein said first portion of said fluid flow is not more than 25% of said fluid flow; and wherein said level of efficiency is between 85% and 100% of maximum efficiency.

2. A pump according to claim 1, wherein said return means comprises a plurality of outlet means for maintaining said second portion of said fluid flow within a predetermined range of flow rates.

3. A pump according to claim 2, wherein:

said casing comprises volute means for achieving lateral hydraulic thrust; and said outlet means comprises a plurality of throttled openings disposed on said casing.

4. A pump according to claim 3, wherein said volute means comprises a pair of volutes disposed diametrically opposite one another on said casing, and said throttled openings are located adjacent said volutes.

5. A pump according to claim 4, wherein said throttled openings comprise generally frustoconical openings converging away from said casing.

6. A pump according to claim 1, wherein said discharge means comprises a variable control valve adjacent said discharge end of said pump.

7. A pump according to claim 1, wherein said second portion of said fluid flow is not less than 70% of said fluid flow.

8. A pump according to claim 1, wherein said inlet end of said pump comprises a flanged fitting coaxial with and beneath said impeller and adapted to be connected to a tailpipe.

9. A method of operating a vertical-axis centilevered-shaft centrifugal pump of the type including an impeller within a pump casing, an intake end in fluid communication with a fluid supply, and a discharge end, said method comprising the following steps:

actuating said impeller to cause fluid from said fluid supply to flow from said intake end and through said casing at a fluid flow rate corresponding to a high level of pump efficiency;

dividing said fluid flow by directing a predetermined first portion of said fluid flow from said casing through said discharge end of said pump and diverting at least 70% of said fluid flow, forming a remaining second portion of said fluid flow, from said casing back to said fluid supply; and limiting said first portion to no more than 25% of said fluid flow.

10. A method according to claim 9, wherein said actuating step further comprises maintaining said level of pump efficiency in a range of between 85% and 100% of maximum pump efficiency.

* * * * *